US007701128B2

(12) United States Patent
Chiang et al.

(10) Patent No.: US 7,701,128 B2
(45) Date of Patent: Apr. 20, 2010

(54) PLANAR LIGHT UNIT USING FIELD EMITTERS AND METHOD FOR FABRICATING THE SAME

(75) Inventors: Liang-You Chiang, Taipei (TW); Jyh-Rong Sheu, Hsinchu (TW); Yu-Yang Chang, Hsinchu (TW); Cheng-Chung Lee, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 986 days.

(21) Appl. No.: 11/049,678

(22) Filed: Feb. 4, 2005

(65) Prior Publication Data

US 2006/0175954 A1 Aug. 10, 2006

(51) Int. Cl.
*H01J 1/62* (2006.01)

(52) U.S. Cl. ..... 313/497; 313/495

(58) Field of Classification Search ..... 313/495–497, 313/294, 306, 309–311, 351, 346 R, 336
See application file for complete search history.

(56) References Cited

U.S. PATENT DOCUMENTS

| | | | | |
|---|---|---|---|---|
| 3,970,887 | A | 7/1976 | Smith et al. | |
| 4,095,133 | A | 6/1978 | Hoeberechts | |
| 5,316,511 | A | 5/1994 | Lee | |
| 5,404,070 | A * | 4/1995 | Tsai et al. | 313/336 |
| 5,527,200 | A | 6/1996 | Lee et al. | |
| 6,028,391 | A * | 2/2000 | Makishima | 313/310 |
| 6,339,281 | B2 | 1/2002 | Lee et al. | |
| 6,346,775 | B1 | 2/2002 | Lee et al. | |
| 6,400,091 | B1 * | 6/2002 | Deguchi et al. | 313/495 |
| 6,414,444 | B2 * | 7/2002 | Fox et al. | 315/169.3 |
| 6,426,590 | B1 | 7/2002 | Chung et al. | |
| 6,440,761 | B1 * | 8/2002 | Choi | 438/20 |
| 6,608,437 | B1 * | 8/2003 | Kishi et al. | 313/495 |
| 6,692,791 | B2 | 2/2004 | Chang et al. | |
| 6,858,981 | B2 * | 2/2005 | Cho et al. | 313/495 |
| 7,239,074 | B2 * | 7/2007 | Wei et al. | 313/495 |
| 2001/0024086 | A1 * | 9/2001 | Fox et al. | 313/495 |
| 2002/0094494 | A1 * | 7/2002 | Chung et al. | 430/311 |
| 2003/0044537 | A1 * | 3/2003 | Chang et al. | 427/402 |

(Continued)

OTHER PUBLICATIONS

Spindt, et al., Journal of Applied Physics, "Physical Properties of Thin-Film Field Emission Cathodes with Molybdenum Cones", vol. 47, pp. 5248-5263 (1976).

(Continued)

*Primary Examiner*—Peter Macchiarolo
(74) *Attorney, Agent, or Firm*—Alston & Bird LLP

(57) ABSTRACT

A planar light unit provided with field emitters and a method for fabricating the same. According to the present invention, the planar light unit has a first substrate, a plurality of first conductive strips, a plurality of second conductive strips, a plurality of field emitters, a second substrate and a fluorescent film. The plurality of first conductive strips are formed over the first substrate, and the plurality of second conductive strips are formed over the first substrate and interposed inbetween the plurality of first conductive strips. The plurality of field emitters are formed in proximity of the plurality of first conductive strips. The second substrate is provided to be attached to and spaced apart from the first substrate to form a chamber therebetween, whereas a fluorescent film is formed over the interior surface of the second substrate facing the plurality of field emitters.

24 Claims, 3 Drawing Sheets

U.S. PATENT DOCUMENTS

2004/0066132 A1* 4/2004 Cho et al. ..... 313/495

OTHER PUBLICATIONS

Liu, et al., Journal of Vacuum Science and Technology B, "Fabrication of Diamond Tips by the Microwave Plasma Chemical Vapor Deposition Technique", vol. 12, pp. 1712-1715 (1994).

Good, et al., Physical Review Letters, "U-Spin Pole Model of Nonleptonic Hyperon Decays", vol. 20, pp. 624-627 (1968).

Xu, et al., Electronics Letters, "Field-Dependence of the Area-Density of 'Cold' Electron Emission Sites on Broad-Area CVD Diamond Films", vol. 29, pp. 1596-1597 (1993).

* cited by examiner

PLANAR LIGHT UNIT USING FIELD EMITTERS AND METHOD FOR FABRICATING THE SAME

BACKGROUND

1. Field of the Invention

The present invention generally relates to a planar lamp for illuminating a flat panel display. More particularly, the present invention relates to a planar light unit of field emitters whose cathodes and gates are arranged in strip shape for use in flat panel displays.

2. Background of the Invention

In recent years, flat panel display devices have been developed and widely used in electronic applications such as computer monitors and televisions. One of the popularly used flat panel display device is an active matrix liquid crystal display (LCD) that provides improved resolution. Other flat panel display devices have been developed in recent years to replace the liquid crystal display panels. One of such devices is a field emission display (FED) device that overcomes some of the limitations of LCD and provides significant advantages over the traditional LCD devices. For instance, the FED devices have higher contrast ratio, larger viewing angle, higher maximum brightness, lower power consumption and a wider operating temperature range when compared to a conventional thin film transistor (TFT) LCD panel.

A most drastic difference between a FED and a LCD is that, unlike the LCD, FED produces its own light source. In a FED, electrons are emitted from a cathode and impinge on phosphors coated on the back of a transparent cover plate to produce an image. Such a cathodoluminescent process is known as one of the most efficient methods for generating light. Contrary to a conventional CRT device, each pixel or emission unit in a FED has its own electron source, i.e., typically an array of emitting microtips. A voltage difference existed between a cathode and a gate which extracts electrons from the cathode and accelerates them toward the phosphor coating. The emission current, and thus the display brightness, is strongly dependent on the work function of the material formed on the emitting microtips.

Referring to FIG. 1A, a top view of a conventional field emission display device 1 using carbon nanotube (CNT) emitters as electron emission sources is shown. FIG. 1B is a partial, cross-sectional view of the conventional field emission display device 1 taken along a line A-A of FIG. 1A. As shown in FIGS. 1A and 1B, the FED device 1 is constructed by a first insulative plate 10, cathode electrodes 12 formed on the first insulative plate 10 by a material that includes metal, CNT emitters 16 formed on the cathode electrodes 12 to form emitter stacks 17, dielectric strips 18 formed on the insulating plate 10 and perpendicular to a multiplicity of the emitter stacks 17, gate electrodes 14 formed on top of the dielectric strips 18, and anode electrodes 15 coated with phosphorous particles formed on a second insulative plate 11 mounted on top of the first insulative plate 10, and an intermittent conductive layer of indium-tin-oxide (ITO) layer 13 formed between the second insulative plate 11 and the anode electrodes 15 to further improve the brightness of the phosphorous layer of the anode electrodes 15 when bombarded by electrons.

It is therefore an object of the present invention to provide a planar light unit utilizes field emitters which higher maximum brightness, lower power consumption and a wider operating temperature range.

BRIEF SUMMARY OF THE INVENTION

In accordance with the present invention, a planar light unit that is equipped with field emitters and a method for fabricating such color lamp are provided.

In a preferred embodiment, a planar light unit in accordance with the present invention is provided with a first substrate; a plurality of first conductive strips formed over the first substrate; a plurality of second conductive strips formed over the first substrate and interposed inbetween the plurality of first conductive strips; a plurality of field emitters formed in proximity of the plurality of first conductive strips; a second substrate attached to and spaced apart from the first substrate to form a chamber therebetween; and a fluorescent film formed over the interior surface of the second substrate facing the plurality of field emitters.

In another preferred embodiment, a method for fabricating a planar light unit comprises the following steps of: providing a first substrate; forming a plurality of first conductive strips over the first substrate; forming a plurality of second conductive strips over the first substrate, the plurality of second conductive strips being interposed inbetween the plurality of first conductive strips; forming a plurality of field emitters in proximity of the plurality of first conductive strips; providing a second substrate attached to and spaced apart from the first substrate to form a chamber therebetween; and forming a fluorescent film over the interior surface of the second substrate facing the plurality of field emitters.

Additional features and advantages of the present invention will be set forth in part in the description which follows, and in part will be obvious from the description, or may be learned by practice of the invention. The features and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate one embodiment of the present invention and together with the description, serves to explain the principles of the invention.

BRIEF DESCRIPTION OF THE DRAWINGS

Reference will now be made in detail to the present embodiment of the invention, an example of which is illustrated in the accompanying drawings. Wherever possible, the same reference numbers are used throughout the drawings to refer to the same or like parts.

DETAILED DESCRIPTION OF THE INVENTION

Figure 1A:
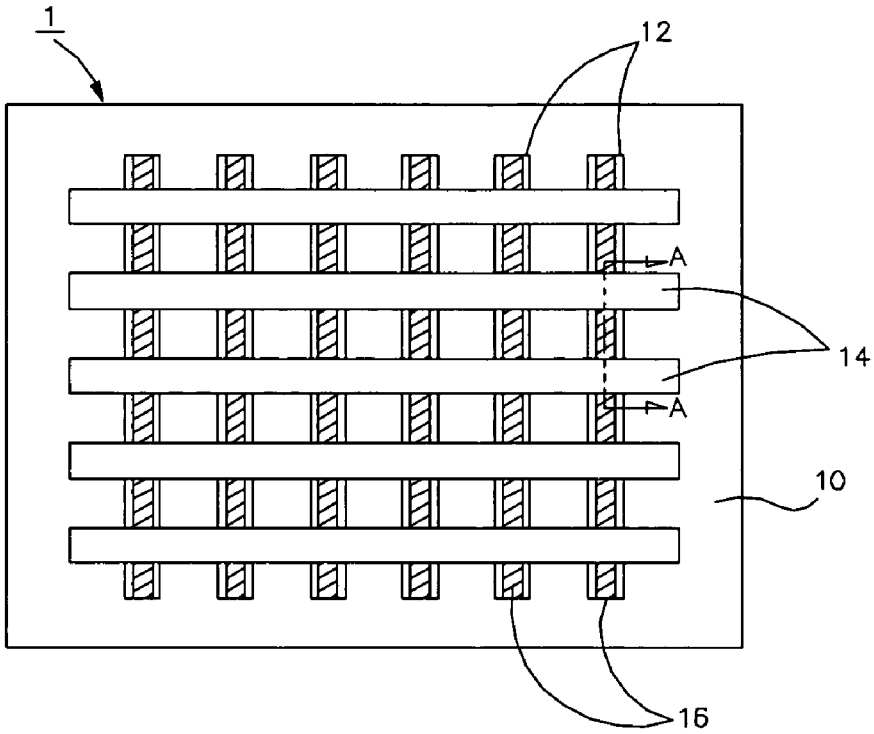
FIGURE 1A (PRIOR ART)
FIG. 1A is a schematic illustrating a conventional field emission display device in a top view.
Figure 1B:
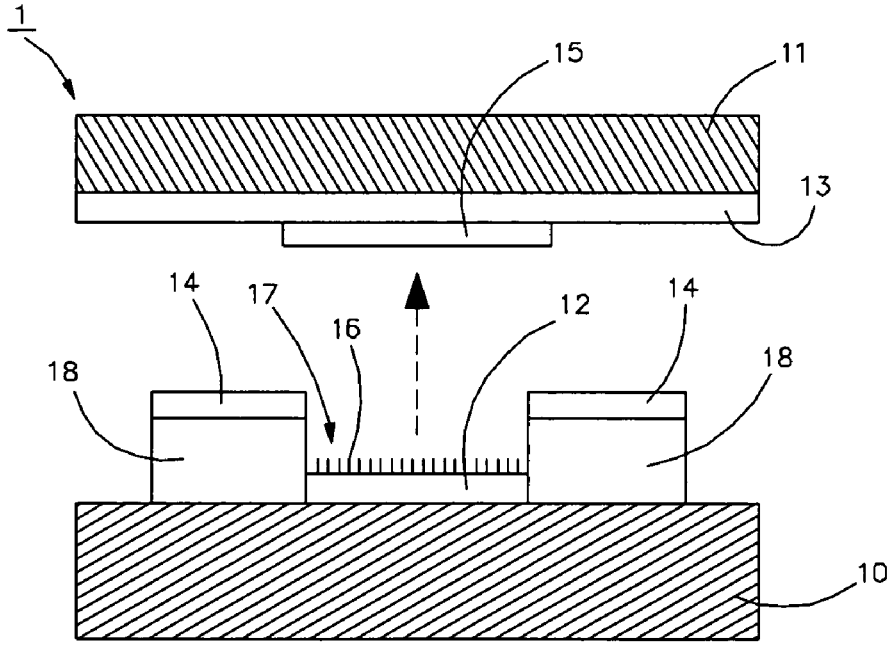
FIGURE 1B (PRIOR ART)
FIG. 1B is a partial, cross-sectional view of the conventional field emission display device taken along a line A-A of FIG. 1A.
Figure 2A:
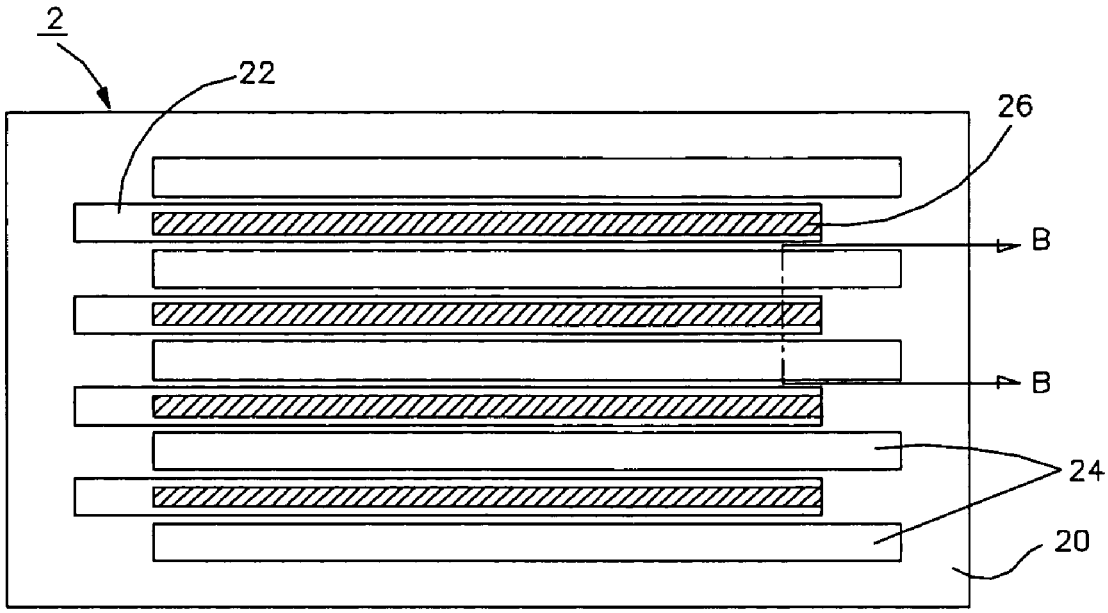
FIG. 2A is a schematic illustrating one preferred embodiment in accordance with a planar light unit of the present invention in a top view.
Figure 2B:
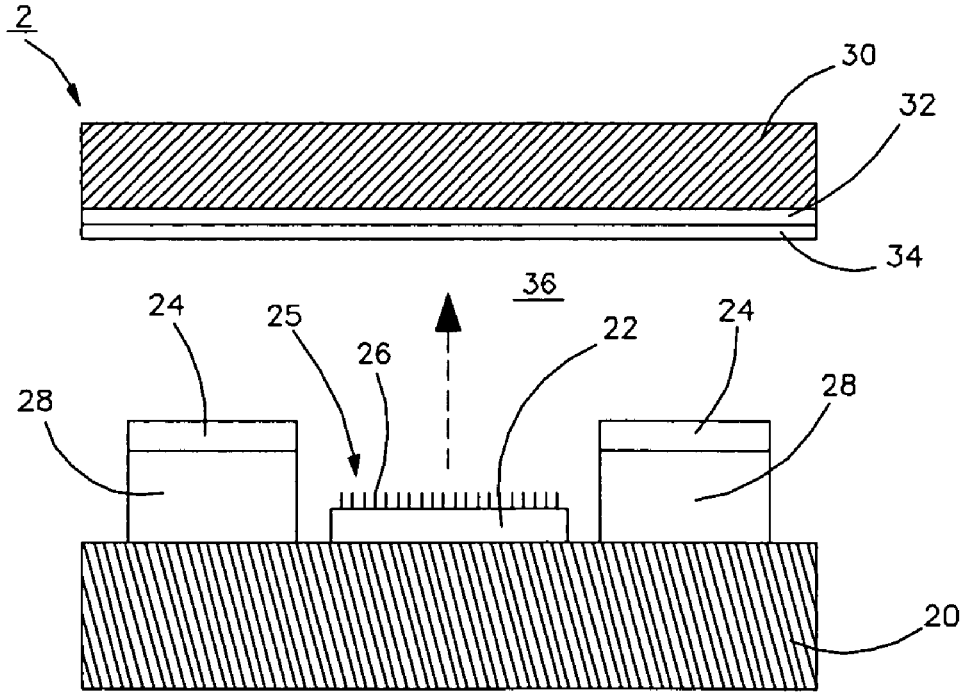
FIG. 2B is a partial, cross-sectional view of FIG. 2A taken along a line B-B.

Referring to FIG. 2A, a top view of one preferred embodiment in accordance with a planar light unit of the present invention is shown. FIG. 2B is a partial, cross-sectional view of the planar light unit of FIG. 2A taken along a line B-B. The planar light unit 2 is constructed by a bottom insulative plate 20 and a top insulative plate 30. The insulative plates 20 and 30 may be suitably formed of an optically transparent glass substrate. On top of the bottom insulative plate 20, is formed a plurality of coating strips 22 of an electrically conductive material, such as silver (Ag), platinum (Pt), gold (Au), tungsten (W), Molybdenum (Mo), Aluminum (Al), indium-tin-oxide (ITO), zinc oxide (ZnO) or the like. The formation of the conductive strips 22 can be implemented by means of chemical vapor deposition (CVD), sputtering, electron-gun deposition, screen-printing or ink-jet. The conductive strips 22 are utilized as the cathode electrodes and are connected to a negative charge (not shown).

As shown in FIGS. 2A and 2B, insulative strips 28 is formed on the first insulative plate 20, which are interposed inbetween cathode strips 22. The formation of the insulative strips 28 can be implemented by depositing a silicon oxide layer followed by the step of patterning the silicon oxide layer. On top of the insulative strips 28, are formed conductive strips 24 by a material, such as silver (Ag), platinum (Pt), gold (Au), tungsten (W), Molybdenum (Mo), Aluminum (Al), indium-tin-oxide (ITO), zinc oxide (ZnO) or the like. The formation of the conductive strips 22 can be implemented by means of chemical vapor deposition (CVD), sputtering, electron-gun deposition, screen-printing or ink-jet. The conductive strips 24 are utilized as the gate electrodes and are connected to a positive charge (not shown). Noted that the gate strips are interposed in between the cathode strips 22 while the insulative strips 28 is utilized as insulative material between the cathode strips 22 and the gate strips 24.

Moreover, emitters 26 are formed on top of the conductive strips 22 to form emitter stacks 25. The emitters 26 emit electrons when charged by the conductive strips 22 with a negative electric charge. The emitters 26 can be deposited by a thick film printing technique on top of the conductive strips 22. The emitters 26 can be suitably formed of carbon nanotubes, graphite, carbon nitride, diamond or diamond-like carbon that are fractured and mixed with a solvent-containing paste in a consistency that is suitable for thick film printing techniques, including screen printing and inkjet printing. Any other suitable nanotube materials, as long as having a diameter that is between about 1 and about 100 nanometers may also be used. It should be noted that the nanotubes are hollow tubes formed in columnar shape and are normally smaller than the diameter of a fiber. A low operating voltage of between about 30 and about 50 volts is normally used to activate the nanotube emitter materials for emitting electrons.

After the emitters 26 are screen printed on the conductive strips 22, the emitter material is hard baked to drive out residual solvents contained in the paste material and to cure the material. The emitter material frequently contains between about 20 wt % and about 80 wt % of emitter while the remainder is a solvent-containing binder. Preferably, the emitter paste contains about 50 wt % emitter and about 50 wt % of the solvent-containing binder. After the hard bake step, tips or sharp points of the emitter protrude above the surface of the emitter layer for use as electron emission sources and to enable the function of the present invention novel device.

The carbon nanotube material may be formed of hollow tubes which are either single-walled or multi-walled nanotubes. The nanotubes, after being fractured, may have a length between about 0.1 μm and about 10 μm. The nanotubes may have an outside diameter between about 1 nm and about 100 nm which relates to an aspect ratio of about 100, when the length is 1 μm and the diameter is 10 μm.

On an inside surface of the top insulative plate 30, a layer of a transparent electrode material 32 is deposited for use as an anode electrode. The transparent electrode 32 can be suitably a material such as indium-tin-oxide that does not affect the optical characteristics of the light panel. On top of the transparent electrode 32, is then deposited by a thick film printing technique a layer of fluorescent powder coating 34. The fluorescent layer 34 can be suitably a phosphor powder. Spacers (not show in the drawing) are utilized for maintaining a suitable spacing between the top insulative plate 30 and the base insulative plate 20 when the plates 20 and 30 are mounted together to form a chamber 36 therebetween. The spacer may be suitably formed of an insulating material by a screen printing technique or pre-fabricated and placed between the two insulative plates 20 and 30.

Figure 3:
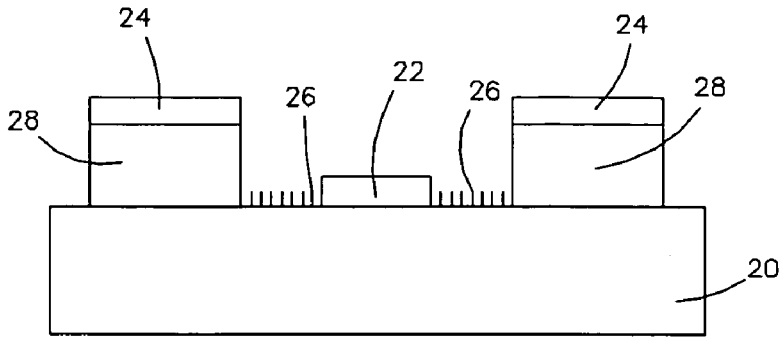
FIG. 3 is a schematic illustrating another preferred embodiment in accordance with a planar light unit of the present invention in a cross-sectional view.

Referring to FIG. 3, a schematic illustrating another preferred embodiment in accordance with a planar light unit of the present invention is shown in a cross-sectional view. In FIG. 3, the field emitters 26 are formed aside the cathode strips 22.

Figure 4:
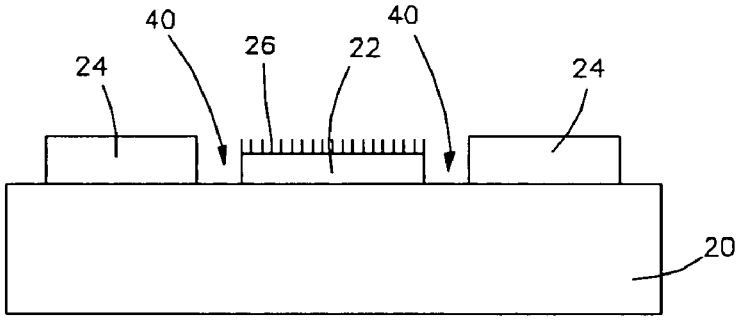
FIG. 4 is a schematic illustrating further preferred embodiment in accordance with a planar light unit of the present invention in a cross-sectional view.

Referring to FIG. 4, a schematic illustrating further preferred embodiment in accordance with a planar light unit of the present invention is shown a cross-sectional view. In FIG. 4, the gate strips 24 are directly formed on the first insulative plate 20. Thus, the cathode strips 22 should be spaced apart from the gate strips 24 by a spacing 40 to ensure that the cathode strips 22 is electrically insulative from the gate strips 24.

Figure 5:
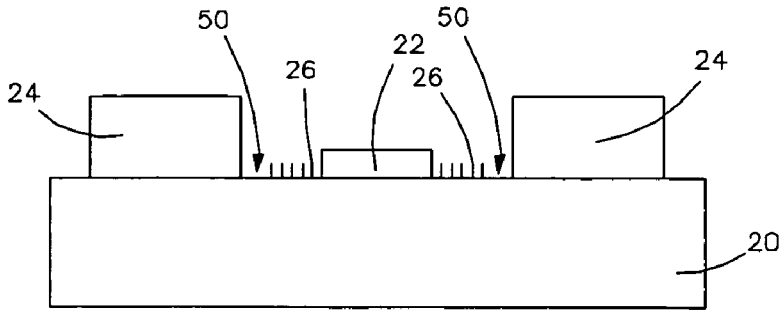
FIG. 5 is a schematic illustrating another further preferred embodiment in accordance with a planar light unit of the present invention in a cross-sectional view.

Referring to FIG. 5, a schematic illustrating another further preferred embodiment in accordance with a planar light unit of the present invention is shown in a cross-sectional view. In FIG. 5, the field emitters 26 are formed aside the cathode strips 22 and the gate strips 24 are directly formed on the first insulative plate 20. Thus, the field emitters 26 should be spaced part from the gate strips 24 by a spacing 50 to ensure that the field emitters 26 is electrically insulative from the gate strips 24.

Though two gate strips 24 associated with one cathode strip 22 are exemplified in FIGS. 2 through 5, the implementations having one gate strip 24 associated with one cathode strip 221, one gate strip 24 associated with one cathode strip 22, and a plurality of the gate strips associated with a plurality of the cathode strips 22 are all feasible. Therefore, it is not intended to limit the scope of the invention to the embodiments disclosed in FIGS. 2-5.

Furthermore, the emitters 26 can be implemented by means of Spindt-type microtips formed of material such as molybdenum (Mo), tungsten (W), doped silicon, doped silicon oxide, doped silicon nitride or the like.

The benefits and the advantages of the present invention novel planar light unit have therefore been amply described in the above description and in the appended drawings of FIGS. 2 through 5. The present invention novel planar field emission color lamp can be advantageously used as a backlight source for a flat panel display device for illumination. High quality illumination for the flat panel display units can thus be achieved at low fabrication cost.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A planar light unit, comprising:

a first substrate;

a plurality of first conductive strips formed over said first substrate, said plurality of first conductive strips being configured to operate as cathode electrodes;

a plurality of second conducive strips formed over said first substrate and interposed in-between and running longitudinally with respect to said plurality of first conductive strips, wherein said second plurality of conductive strips do not overlap said first plurality of conductive strips, said plurality of second conductive strips being configured to operate as gate electrodes;

a plurality of field emitters formed and positioned above and in connection with a respective conductive strip of said plurality of first conductive strips;

a second substrate attached to and spaced apart from said first substrate to form a chamber therebetween; and a fluorescent film formed over an interior surface of said second substrate facing said plurality of field emitters.

2. The planar unit as claimed in claim 1, said plurality of field emitters are tips formed of a material selected from a group consisting of molybdenum, tungsten, silicon, silicon oxide and silicon nitride.

3. The planar unit as claimed in claim 1, wherein said plurality of field emitters are formed of a material selected from a group consisting of carbon nanotubes, graphite, carbon nitride, diamond, diamond -like carbon.

4. The planar unit as claimed in claim 1, wherein said first conductive strips are formed of a conductive material selected from a group consisting of silver, platinum, gold, tungsten, molybdenum, aluminum, indium-tin oxide and zinc oxide.

5. The planar unit as claimed in claim 1, wherein said second conductive strips are formed of a conductive material selected from a group consisting of silver, platinum, gold, tungsten, molybdenum, aluminum, indium-tin oxide and zinc oxide.

6. The planar unit as claimed in claim 1, wherein said plurality of first conductive strips are substantiality in parallel with said plurality of second conductive strips.

7. The planar unit as claimed in claim 1, further comprising an insulative layer formed between said plurality of second conductive strips and the first substrate.

8. The planar unit as claimed in claim 1, wherein one of said first conductive strips is associated with one of said second conductive strips.

9. The planar unit as claimed in claim 1, wherein one of said first conductive strips is associated with at least two of said second conductive strips.

10. The planar unit as claimed in claim 1, wherein at least two of said first conductive strips are associated with one of said second conductive strips.

11. The planar unit as claimed in claim 1, wherein at least two of said first conductive strips are associated with at least two of said second conductive strips.

12. The planar light unit as claimed in claim 1, wherein the plurality of emitters are separated from the second conductive strips by a gap.

13. A method for fabricating a planar light unit, comprising:

providing a substrate;

forming a plurality of first conductive strips over first substrate, said plurality of first conductive strips being configured to operate as cathode electrodes;

forming a plurality of second conductive strips over said first substrate, said plurality of second conductive strips being interposed in-between and running longitudinally with respect to said plurality of first conductive strips, wherein said second plurality of conductive strips do not overlap said first plurality of conductive strips, said plurality of second conductive strips being configured to operate as gate electrodes;

forming a plurality of field emitters positioned above and in connection with a respective conductive strip of said plurality of first conductive strips;

providing a second substrate attached to and spaced apart from said first substrate to form a chamber therebetween; and forming a fluorescent film over the interior surface of said second substrate facing said plurality of field emitters.

14. The method as claimed in claim 13, wherein said plurality of field emitters are tips formed of a material selected from a group consisting of carbon nanotubes, graphite, carbon nitride, diamond, diamond-like carbon.

15. The method as claimed in claim 13, wherein said plurality of field emitters are formed of a material selected from a group consisting of carbon nanotubes, graphite, carbon nitride, diamond, diamond-like carbon.

16. The method as claimed in claim 13, wherein said first conductive strips are formed of a conductive material selected from a group consisting of silver, platinum, gold, tungsten, molybdenum, aluminum, indium-tin oxide and zinc oxide.

17. The method as claimed in claim 13, wherein said second conductive strips are formed of a conductive material selected from a group consisting of silver, platinum, gold, tungsten, molybdenum, aluminum, indium-tin oxide and zinc oxide.

18. The method as claimed in claim 13, wherein said plurality of first conductive strips are substantially paralleled with said plurality of second conductive strips.

19. The method as claimed in claim 13, further comprising the step of forming an insulative layer between said plurality of second conductive strips and said first substrate.

20. The method as claimed in claim 13, wherein one of said first conductive strips is associated with one of said second conductive strips.

21. The method as claimed in claim 13, wherein one of said first conductive strips is associated with at least two of said second conductive strips.

22. The method as claimed in claim 13, wherein at least two of said first conductive strips are associated with one of said second conducive strips.

23. The method as claimed in claim 13, wherein at least two of said first conductive strips are associated with at least two of said second conducive strips.

24. The method as claimed in claim 13, wherein the plurality of emitters are formed such that the plurality of emitters are separated from the second conductive strips by a gap.

* * * * *